US010847914B2

(12) United States Patent
Kobayashi et al.

(10) Patent No.: US 10,847,914 B2
(45) Date of Patent: Nov. 24, 2020

(54) MALE TERMINAL

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Shingo Kobayashi, Mie (JP); Noriyuki Uematsu, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/491,637

(22) PCT Filed: Feb. 21, 2018

(86) PCT No.: PCT/JP2018/006119
§ 371 (c)(1),
(2) Date: Sep. 6, 2019

(87) PCT Pub. No.: WO2018/163814
PCT Pub. Date: Sep. 13, 2018

(65) Prior Publication Data

US 2020/0036126 A1 Jan. 30, 2020

(30) Foreign Application Priority Data

Mar. 8, 2017 (JP) ..... 2017-044016

(51) Int. Cl.
*H01R 13/04* (2006.01)
*H01R 4/12* (2006.01)
(Continued)

(52) U.S. Cl.
CPC ..... *H01R 13/04* (2013.01); *H01R 4/12* (2013.01); *H01R 13/11* (2013.01); *H01R 13/20* (2013.01)

(58) Field of Classification Search
CPC ..... H01R 13/04; H01R 13/20
See application file for complete search history.

(56) References Cited

U.S. PATENT DOCUMENTS 1,552,262 A * 9/1925 Betz ..... H01R 13/04 439/732
3,670,294 A * 6/1972 Johnson ..... H01R 13/41 439/697

(Continued)

FOREIGN PATENT DOCUMENTS

JP 2-8880 1/1990
JP 3-214574 9/1991

(Continued)

OTHER PUBLICATIONS

International Search Report dated May 1, 2018.

*Primary Examiner* — Ross N Gushi
(74) *Attorney, Agent, or Firm* — Gerald E. Hespos; Michael J. Porco; Matthew T. Hespos

(57) ABSTRACT

A male terminal disclosed in this specification is a male terminal 10 fittable to a female terminal 20 including at least a pair of resilient contact pieces, and includes a terminal contact portion 11 having a pin shape and configured to contact the resilient contact pieces 21 of the female terminal 20 when the male terminal 10 is fit to the female terminal 20, and projections 12 projecting from an outer peripheral surface of the terminal contact portion 11 and arranged to be fit between side edges 24 of pairs of adjacent ones of the resilient contact pieces 21 of the female terminal 20 when the male terminal 10 is fit to the female terminal 20.

7 Claims, 8 Drawing Sheets

(51) Int. Cl.
*H01R 13/11* (2006.01)
*H01R 13/20* (2006.01)

(56) References Cited

U.S. PATENT DOCUMENTS

| | | | | | |
|---|---|---|---|---|---|
| 4,278,313 | A * | 7/1981 | Blakesley | H01R 13/28 | 439/290 |
| 4,878,861 | A * | 11/1989 | Kendall | H01R 12/585 | 439/751 |
| 5,649,837 | A * | 7/1997 | Arnold | H01R 13/6315 | 439/247 |
| 5,897,401 | A * | 4/1999 | Fili | H01R 13/41 | 411/451.1 |
| 6,011,222 | A * | 1/2000 | Sekiya | H01R 12/58 | 174/265 |
| 6,042,429 | A * | 3/2000 | Bianca | H01R 13/41 | 439/733.1 |
| 6,229,101 | B1 * | 5/2001 | Sekiya | H01R 12/58 | 174/265 |
| 9,270,043 | B2 * | 2/2016 | Kobayashi | H01R 13/28 | |
| 9,293,850 | B2 * | 3/2016 | Gilliam | H01R 13/04 | |
| 9,484,644 | B2 * | 11/2016 | Ohkubo | H01R 4/4818 | |
| 9,570,832 | B2 * | 2/2017 | Chew | H01R 43/26 | |
| 9,583,858 | B2 * | 2/2017 | Hashimoto | H01R 13/41 | |
| 9,595,782 | B2 * | 3/2017 | Farole | H01R 13/41 | |
| 10,236,603 | B2 * | 3/2019 | Goto | H01R 43/16 | |
| 2009/0170381 | A1 * | 7/2009 | Sommovigo | H01R 13/04 | 439/884 |
| 2013/0210292 | A1 | 8/2013 | Schmidt et al. | | |
| 2016/0134030 | A1 | 5/2016 | Ohkubo et al. | | |
| 2020/0169021 | A1 * | 5/2020 | Lane | H01R 13/11 | |

FOREIGN PATENT DOCUMENTS

| | | |
|---|---|---|
| JP | 2014-107079 | 6/2014 |
| JP | 2015-002072 | 1/2015 |
| JP | 2015-82453 | 4/2015 |
| JP | 2015-222621 | 12/2015 |

* cited by examiner

MALE TERMINAL

BACKGROUND

Field of the Invention

This specification relates to a male terminal.

Related Art

Japanese Unexamined Patent Publication No. 2015-82453 discloses a male terminal that includes a pin-like insertion portion to be inserted into a box-like portion of a female terminal and a wire crimping portion to be crimped to a core exposed by stripping a sheath of a wire. A front part of the female terminal includes two resilient pieces, and a rear part has a wire crimping portion to be crimped to a wire. The insertion portion of the male terminal is inserted into the box-like portion of the female terminal and is pressed into contact with the resilient pieces of the female terminal so that the male and female terminals become electrically conductive.

In this configuration, vibration applied to the wire crimped to the male terminal or the female terminal can twist the male terminal. Thus, a terminal contact point slides and can wear to cause a contact failure. A contact pressure of the female terminal can be increased to suppress the twisting of the male terminal. However, the increased contact pressure increases an insertion force required for the male terminal and makes insertion more difficult.

SUMMARY

The invention relates to a male terminal that can fit to a female terminal that includes at least two resilient contact pieces. The male terminal includes a pin-shaped terminal contact portion that is configured to contact the resilient contact pieces of the female terminal when the male terminal is fit to the female terminal. A projection projects from an outer peripheral surface of the terminal contact portion and is arranged to be fit between side edges of two adjacent resilient contact pieces of the female terminal when the male terminal is fit to the female terminal.

According to this configuration, when the male terminal and the female terminal are fit together, the projection of the male terminal enters between the side edges of the two adjacent resilient contact pieces of the female terminal. Then, even if the male terminal is subject to vibration, the projection of the male terminal butts against the side edge of the resilient contact piece of the female terminal to prevent twisting of the male terminal.

The projection may be in contact with the resilient contact pieces when the male terminal is fit to the female terminal. According to this configuration, a contact area when the male terminal and the female terminal are fit is increased, and contact resistance between the male terminal and the female terminal can be reduced.

Further, the number of projections may be the same as the number of resilient contact pieces, and one projection is fit between the side edges of two adjacent resilient contact pieces. According to this configuration, the projections of the male terminal are fit between all adjacent resilient contact pieces of the female terminal. This causes a load applied to the resilient contact pieces when the projections butt against the resilient contact pieces due to the twisting of the male terminal to be dispersed to each resilient contact piece. Therefore, a load applied to one resilient contact piece of the female terminal due to twisting of the male terminal can be reduced.

Accordingly, the male terminal disclosed in this specification prevents twisting of the male terminal can be prevented.

DETAILED DESCRIPTION

An embodiment is described with reference to FIGS. 1 to 8.

Figure 1:
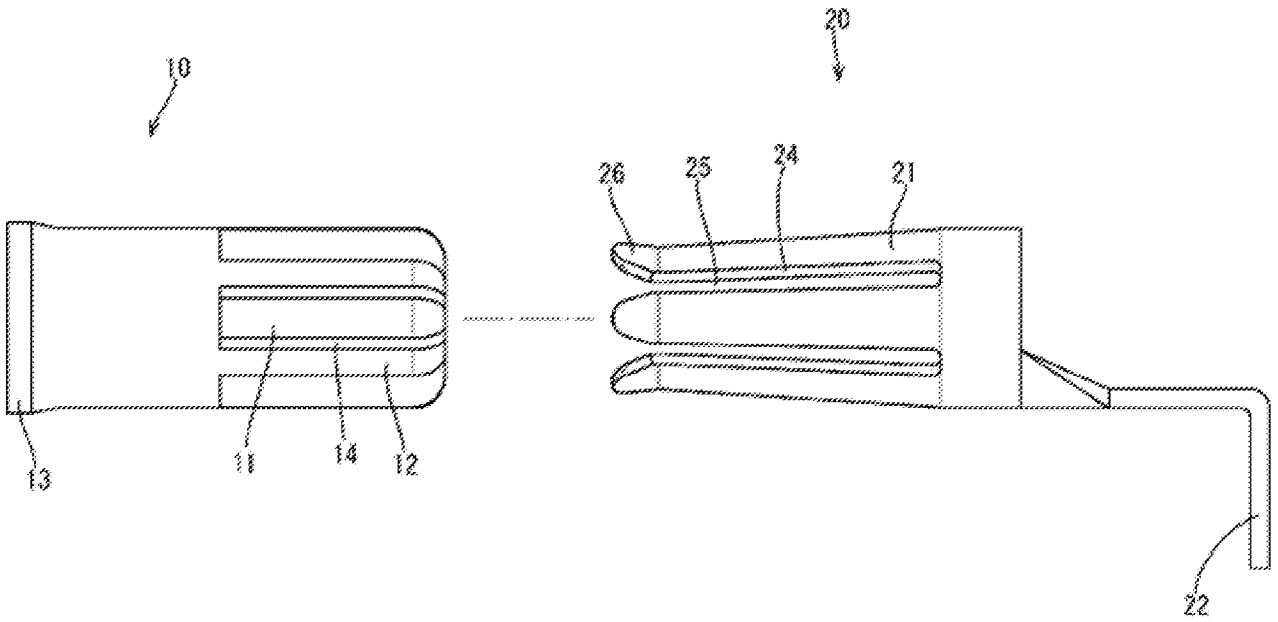
FIG. 1 is a front view showing a state before a male terminal and a female terminal in an embodiment are fit.

A female terminal 20 is formed by bending a metal plate material of copper, copper alloy or the like stamped into a predetermined shape. Further, plating of tin or the like is applied to the entire surface of the female terminal 20. As shown in FIG. 1, the female terminal 20 includes resilient contact pieces 21 and a wire crimping portion 22.

Figure 2:
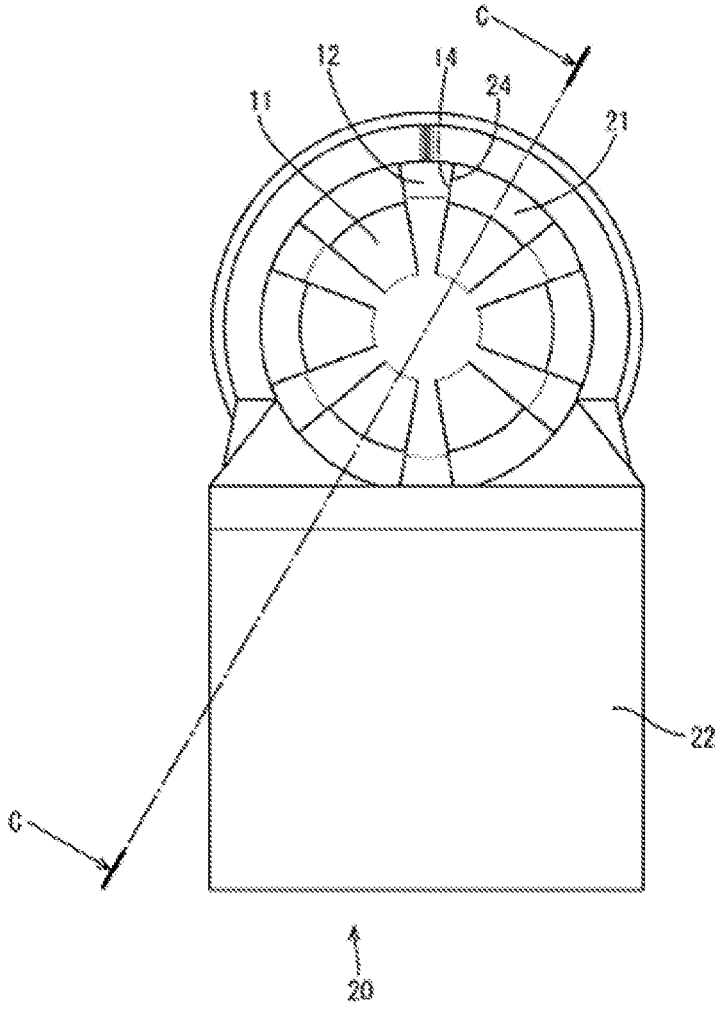
FIG. 2 is a right side view showing the state of FIG. 1.
Figure 4:
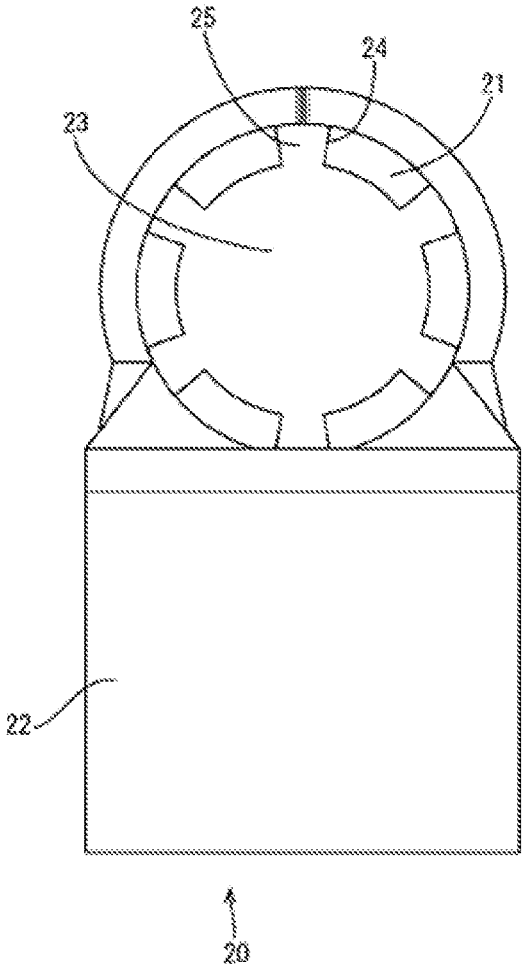
FIG. 4 is a view showing only the female terminal in FIG. 2.

Six resilient contact pieces 21 of the female terminal 20 are arranged at equal intervals in a circumferential direction as shown in FIGS. 2 and 4. Each resilient contact piece 21 is paired with the opposite resilient contact piece 21. An inner area surrounded by the respective resilient contact pieces 21 serves as a hollow portion 23, as shown in FIG. 4. A terminal contact portion 11 of a male terminal 10 to be described later is inserted into this hollow portion 23. Further, as shown in FIG. 1, each resilient contact piece 21 is somewhat inclined radially inwardly. In this way, when the male terminal 10 and the female terminal 20 are fit, the terminal contact portion 11 of the male terminal 10 is pressed resiliently by the resilient contact pieces 21. Further, tip parts 26 of the resilient contact pieces 21 are bent somewhat radially out so that the terminal contact portion 11 of the male terminal 10 to be described later is inserted easily.

The wire crimping portion 22 of the female terminal 20 is crimped to an unillustrated wire. In this way, the female terminal 20 and the wire become electrically conductive.

The male terminal 10 is formed by working a round bar material made of metal such as copper or copper alloy by heading, cutting or the like. Further, plating of tin or the like is applied to the entire surface of the male terminal 10. As shown in FIG. 1, the male terminal 10 includes the terminal contact portion 11, a wire crimping portion 13 and projections 12 projecting out from the outer peripheral surface of the terminal contact portion 11.

As shown in FIG. 1, the terminal contact portion 11 of the male terminal 10 is formed into a pin extending in a fitting direction to the female terminal 20. Further, the projections 12 are formed by cutting the outer peripheral surface of the terminal contact portion 11.

Figure 3:
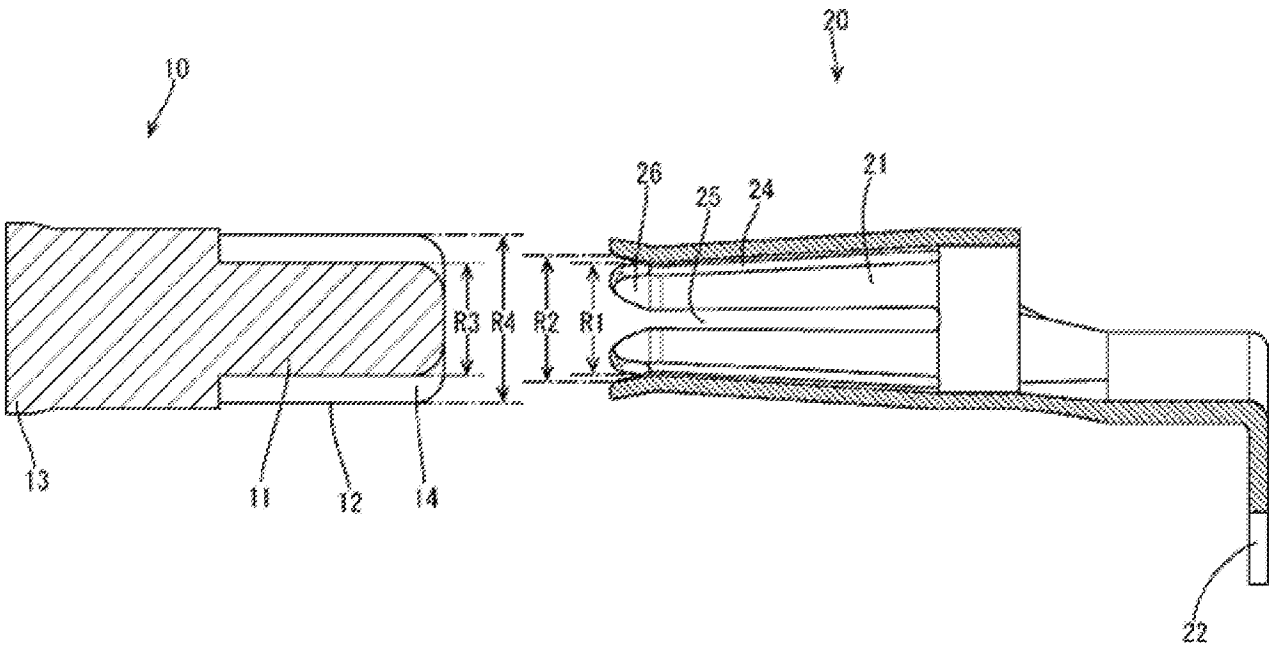
FIG. 3 is a section along C-C in FIG. 2.

As shown in FIG. 3, an inner diameter R3 of the terminal contact portion 11 is larger than a minimum diameter R1 between the inner surfaces of a pair of the resilient contact pieces 21 and smaller than a diameter R2 between the inner surfaces of the pair of resilient contact pieces 21 at an entrance. Further, an outer diameter R4 of a pair of the projections 12 is larger than the inner diameter R3 of the terminal contact portion 11.

Figure 5:
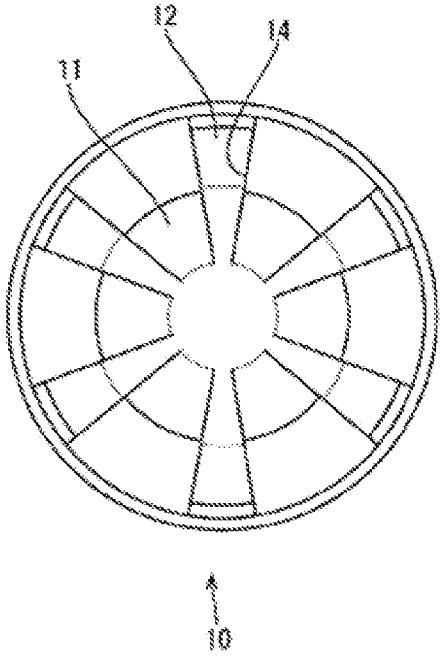
FIG. 5 is a view showing only the male terminal in FIG. 2.

Six projections 12 are arranged at equal intervals in the circumferential direction as shown in FIGS. 2 and 5. The number of the projections 12 is the same as the number of resilient contact pieces 21. Each projection 12 is worked to be fit into a space 25 between side edges 24 of two adjacent resilient contact pieces 21, as shown in FIG. 4, and side edges 14 of the projection 12 are in contact with the side edges 24 of the resilient contact pieces 21 when the male terminal 10 and the female terminal 20 are fit as described later.

The wire crimping portion 13 of the male terminal 10 is crimped to an unillustrated wire. In this way, the male terminal 10 and the wire become electrically conductive.

Next, functions of this embodiment are described.

Figure 6:
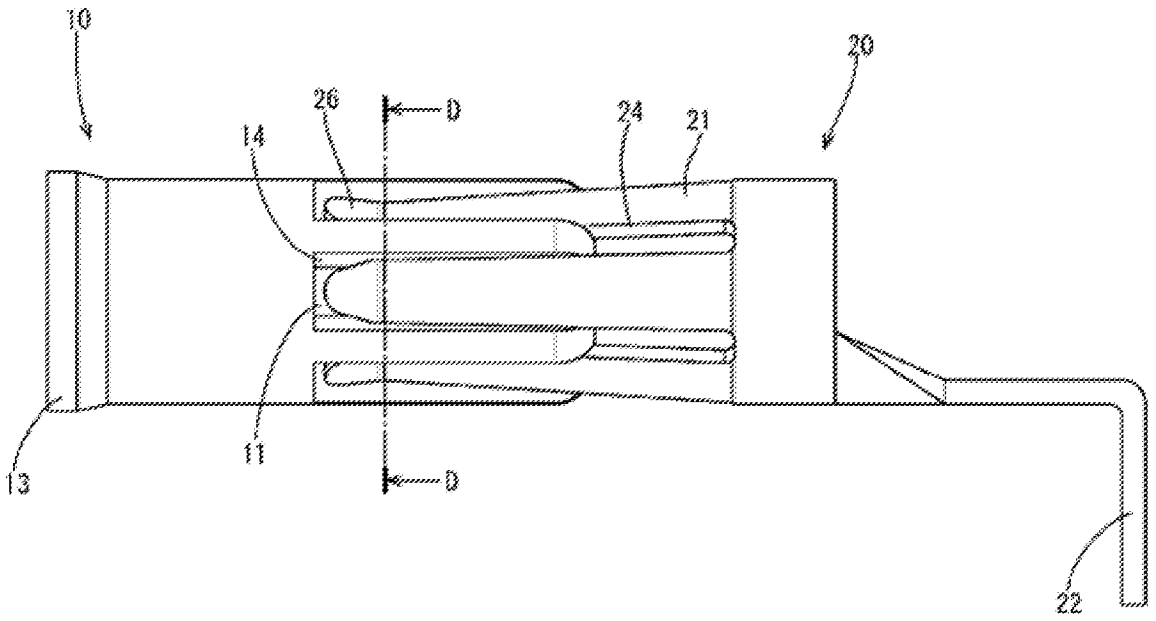
FIG. 6 is a front view showing a state after the male terminal and the female terminal in the embodiment are fit.

When the male terminal 10 and the female terminal 20 are fit together, the projections 12 of the male terminal 10 enter the spaces 25 between the side edges 24 of the adjacent resilient contact pieces 21 of the female terminal 20, as shown in FIG. 6. Thus, even if the male terminal 10 is going to be twisted, for example, due to vibration applied from outside to the unillustrated wire mounted on the wire crimping portion 13 of the male terminal 10, the projections 12 butt against the side edges 24 of the adjacent resilient contact pieces 21. In this way, twisting of the male terminal 10 can be prevented.

Figure 8:
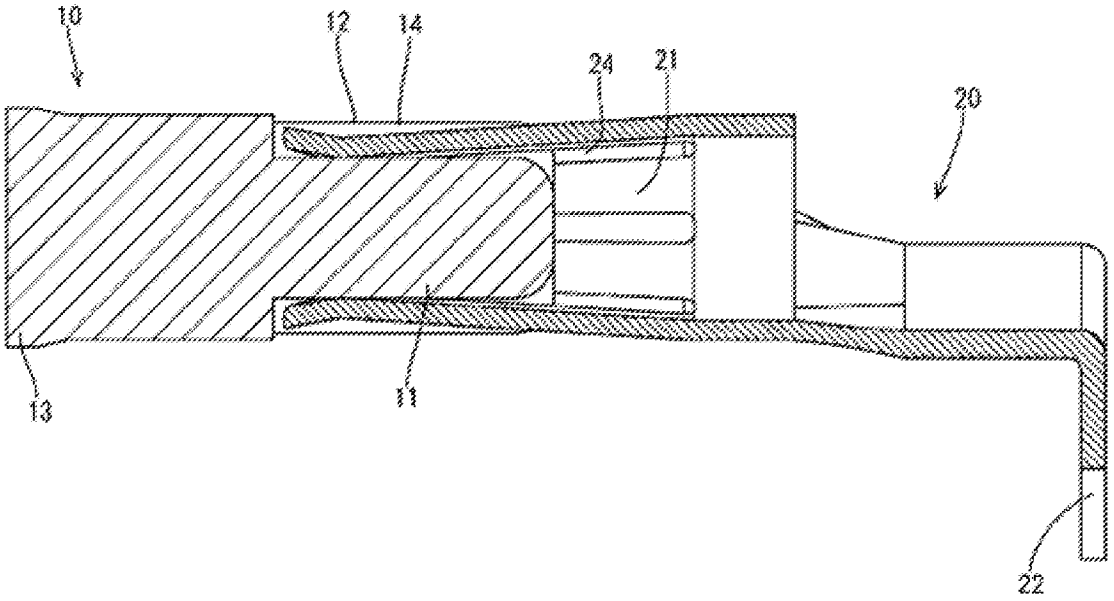
FIG. 8 is a section along E-E in FIG. 7.

When the male terminal 10 and the female terminal 20 are fit, the terminal contact portion 11 of the male terminal 10 is pressed resiliently by the resilient contact pieces 21 of the female terminal 20, as shown in FIG. 8. In this way, the male terminal 10 and the female terminal 20 contact each other and become electrically conductive.

Figure 7:
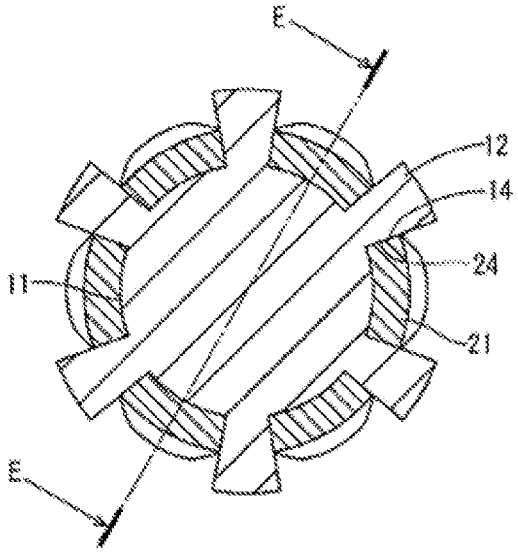
FIG. 7 is a section along D-D in FIG. 6.

Further, as shown in FIG. 7, the side edges 14 of the projections 12 of the male terminal 10 are in contact with the side edges 24 of the adjacent resilient contact pieces 21 of the female terminal 20. Thus, a contact area of the female terminal 10 and the female terminal 20 increases. In this way, contact resistance between the male terminal 10 and the female terminal 20 can be reduced.

Further, as shown in FIG. 7, one projection 12 of the male terminal 10 is fit in each space 25 of the female terminal 20. In this way, when the male terminal 10 is twisted, each projection 12 of the male terminal 10 butts against the side edge 24 of the corresponding resilient contact piece 21 of the female terminal 20. Thus, a load applied to the resilient contact pieces 21 when the projections 12 butt against the resilient contact pieces 21 due to the twisting of the male terminal 10 is dispersed to each resilient contact piece 21. In this way, a load applied to one resilient contact piece 21 due to the twisting of the male terminal 10 can be reduced.

As described above, according to this embodiment, the projection 12 of the male terminal 10 enters the space 25 between the side edges 24 of at least two of the resilient contact pieces 21 of the female terminal 20 when the male terminal 10 and the female terminal 20 are fit. Then, even if the male terminal 10 is twisted, the projection 12 of the male terminal 10 butts against the side edge 24 of the resilient contact piece 21 of the female terminal 20 to prevent the twisting of the male terminal 10.

Further, the projections 12 are in contact with the side edges 24 of the adjacent resilient contact pieces 21 when the male terminal 10 and the female terminal 20 are fit together. Thus, the contact area increases when the male terminal 10 and the female terminal 20 are fit together. Thus, contact resistance between the male terminal 10 and the female terminal 20 can be reduced.

Further, the projections 12 of the male terminal 10 are fit between adjacent resilient contact pieces 21 of the male terminal 20. This causes a load applied to the resilient contact pieces 21 when the projections 12 butt against the resilient contact pieces 21 due to the twisting of the male terminal 10 to be dispersed to each resilient contact piece 21. Therefore, a load applied to one resilient contact piece 21 of the female terminal 20 due to the twisting of the male terminal 10 can be reduced The male terminal disclosed by this specification is not limited to the above described and illustrated embodiment. For example, the following various modes are also included.

The number of the projections 12 are equal to the number of the resilient contact pieces 21 in the above embodiment. However, there may be more projections 12 than resilient contact pieces 21 or fewer projections 12 than resilient contact pieces 21.

Although six projections 12 of the male terminal 10 and six side edges 24 of the resilient contact pieces 21 of the female terminal 20 are provided, the number of the projections 12 and the number of the side edges 24 may differ.

Although the projections 12 of the male terminal 10 are in contact with the side edges 24 of the adjacent resilient contact pieces 21 of the female terminal 20 in the above embodiment, the projections 12 may not be in contact with the side edges 24.

Although one projection 12 of the male terminal 10 is fit in each space 25 of the female terminal 20 in the above embodiment, one or more projections 12 or no projection 12 may be fit in the space 25.

LIST OF REFERENCE SIGNS

10 . . . male terminal
11 . . . terminal contact portion
12 . . . projection
13 . . . wire crimping portion
14 . . . side edge
20 . . . female terminal
21 . . . resilient contact piece
22 . . . wire crimping portion
24 . . . side edge
26 . . . tip part

The invention claimed is:

1. A male terminal having opposite first and second longitudinal ends, the first longitudinal end of the male terminal being fittable to a female terminal including at least a pair of resilient contact pieces and comprising:

a terminal contact portion having a pin shape and configured to contact the resilient contact pieces of the female terminal when the male terminal is fit to the female terminal; and a plurality of projections projecting radially outwardly of the terminal contact portion from an outer peripheral surface of the terminal contact portion and arranged in a circumferential direction of the terminal contact portion, spaces being defined between the projections, the spaces and the projections extending to the first longitudinal end of the male terminal and being dimensioned to receive the resilient contact pieces of the female terminal therein, the projections being dimensioned to be fit between side edges of pairs of adjacent ones of the resilient contact pieces of the female terminal when the male terminal is fit to the female terminal;

each of the projections becoming wider in the circumferential direction from a base end part on the outer peripheral surface side toward a tip part in a radially outward direction.

2. The male terminal of claim 1, wherein the plurality of projections define a symmetrical array of projections with pairs of projections arranged diametrically opposite one another.

3. A terminal fitting assembly, comprising:

a female terminal having a plurality of resilient contact pieces circumferentially spaced from one another; and a male terminal coupled to the female terminal and including a terminal contact portion having a pin shape and an outer peripheral surface, a plurality of projections projecting radially outward of the outer peripheral surface of the terminal contact portion and arranged in a circumferential direction of the terminal contact portion, the plurality of projections becoming wider in the circumferential direction from a base end part of the outer peripheral surface side toward a tip part in a radially outward direction, wherein the plurality of projections are individually fit between side edges of pairs of adjacent ones of the plurality of resilient contact pieces.

4. The terminal fitting assembly of claim 3, wherein the projection is in contact with the resilient contact pieces when the male terminal is fit to the female terminal.

5. The terminal fitting assembly of claim 4, wherein the projections are equal in number to the resilient contact pieces.

6. The terminal fitting assembly of claim 3, wherein the male terminal has opposite longitudinal ends, the projections and spaces between the projections extend to one of the longitudinal ends of the male terminal.

7. The terminal fitting assembly of claim 3, wherein the plurality of projections define a symmetrical array of projections with pairs of projections arranged diametrically opposite one another.

* * * * *